US006612057B2

(12) United States Patent
Shoemaker et al.

(10) Patent No.: US 6,612,057 B2
(45) Date of Patent: Sep. 2, 2003

(54) SELF CENTERING DISPLAY FIXTURE

(75) Inventors: Gregory D. Shoemaker, Blue Springs, MO (US); Randy G. Postle, Shawee, KS (US)

(73) Assignee: Hot Buys, Inc., Blue Springs, MO (US)

( * ) Notice: Subject to any disclaimer, the term of this patent is extended or adjusted under 35 U.S.C. 154(b) by 32 days.

(21) Appl. No.: 09/804,572

(22) Filed: Mar. 12, 2001

(65) Prior Publication Data

US 2001/0010134 A1 Aug. 2, 2001

Related U.S. Application Data

(63) Continuation-in-part of application No. 09/494,809, filed on Jan. 31, 2000, now Pat. No. 6,412,204.

(51) Int. Cl.[7] ..... A47F 5/00; G09F 15/00

(52) U.S. Cl. ..... 40/607; 40/608; 248/289.31

(58) Field of Search ..... 40/607, 606, 608, 40/642.01; 248/289.31, 900, 145

(56) References Cited

U.S. PATENT DOCUMENTS

| | | | | |
|---|---|---|---|---|
| 1,299,343 A | * | 4/1919 | Hoag | 40/607 |
| 2,054,281 A | | 9/1936 | Chauncey | |
| 2,147,890 A | | 2/1939 | Glasgow | |
| 3,637,178 A | | 1/1972 | Golden | |
| 3,897,926 A | * | 8/1975 | Silver | 248/223 |
| 4,341,028 A | | 7/1982 | Brown | |
| 4,616,799 A | | 10/1986 | Rebentisch | |
| 4,783,033 A | * | 11/1988 | Valiulis | 248/220.4 |
| 5,233,773 A | | 8/1993 | Reynolds | |
| 5,284,259 A | | 2/1994 | Conway et al. | |
| 5,375,803 A | | 12/1994 | Kump | |
| 5,437,409 A | | 8/1995 | Coushaine | |
| 5,454,638 A | * | 10/1995 | Bird et al. | 312/408 |
| 5,458,242 A | | 10/1995 | Baka et al. | |
| 5,470,138 A | | 11/1995 | Kump | |
| 5,490,651 A | | 2/1996 | Kump | |
| D381,041 S | | 7/1997 | Lammers et al. | |

(List continued on next page.)

OTHER PUBLICATIONS

Photograph of fixture without self–centering recess first offered for commercial use in Jul., 1998.

(List continued on next page.)

*Primary Examiner*—Lynne H. Browne
*Assistant Examiner*—Kenn Thompson
(74) *Attorney, Agent, or Firm*—Hovey Williams LLP

(57) ABSTRACT

A display fixture is provided for mounting to shelving in a retail store and presenting products or advertising so as to be more readily visible to the customer walking down the aisle. The display feature includes a mount, a coupler integrally provided with the mount for attachment of the mount to an upright surface such as a support of shelving or other retail displays, a display arm swingably carried by the mount, and a centering device on the extension arm which is positioned for receipt in a depression such as a hole in the mount. In a centered position, the display arm has an extension arm portion which extends preferably perpendicular to the upright surface with the centering device received in the depression, and which swings freely from the centered position with gravity returning the display arm to the centered position without the need for springs or other biasing devices. A product carrier and advertising display may be carried by the extension arm to extend into the aisle, and a screw may be threaded through the mount to hold the mount securely in position.

21 Claims, 1 Drawing Sheet

U.S. PATENT DOCUMENTS

| | | | |
|---|---|---|---|
| 5,647,566 | A | 7/1997 | Kump |
| 5,664,749 | A | 9/1997 | Kump et al. |
| 5,678,794 | A | 10/1997 | Kump |
| 5,720,398 | A | 2/1998 | Kump et al. |
| D397,366 | S | 8/1998 | Wamsley |
| D404,232 | S | 1/1999 | Kump et al. |
| 5,906,283 | A | 5/1999 | Kump et al. |
| 5,908,119 | A | 6/1999 | Kump et al. |
| 6,006,463 | A | 12/1999 | Mueller |
| 6,026,603 | A | 2/2000 | Kump et al. |
| D422,889 | S | 4/2000 | Gray |
| D423,336 | S | 4/2000 | Gray |
| D423,592 | S | 4/2000 | Wamsley |
| D424,121 | S | 5/2000 | Kump |
| D425,134 | S | 5/2000 | Kump |
| D425,566 | S | 5/2000 | Mueller et al. |
| D425,939 | S | 5/2000 | Kump et al. |
| 6,082,687 | A | 7/2000 | Kump et al. |
| 6,119,990 | A | 9/2000 | Kump et al. |
| 6,289,618 | B1 * | 9/2001 | Kump et al. ..... 40/657 |
| 6,349,909 | B1 * | 2/2002 | Zarrow et al. ..... 40/642.01 |

OTHER PUBLICATIONS

Drawings of fixture from U.S. Pat. No. 6,412,204 first offered for commerical use in Jun., 1999.

Photograph of fixture first offered for commercial use in Sep., 1999.

Photograph of fixture with integral mounting tabs first offered for commerical use in Nov., 2000.

* cited by examiner

SELF CENTERING DISPLAY FIXTURE

This application is a continuation-in-part of application Ser. No. 09/494,809 filed Jan. 31, 2000, now U.S. Pat. No. 6,412,204 issued Jul. 2, 2002.

BACKGROUND OF THE INVENTION

1. Field of the Invention

This invention concerns a display fixture useful at retail locations which includes an arm which is swingably mounted and centers itself to extend at an angle into the aisleway. More particularly, the display fixture hereof includes an arm carrying advertising or product at a remote end and at a proximate end is swingably held by a support which may be fabricated into a single, unitary bracket and mounted to conventional retail fixtures.

2. Description of the Prior Art

Various types of display fixtures are used in retail establishments to display goods. Shelves are most typically employed to carry products, but a variety of different clips and carriers extend from pegboards to provide product displays and advertising. Such fixtures are conventionally aligned along the aisles and on the ends of the aisles. It has been considered undesirable to extend product displays laterally into the aisles because they interfere with ordinary traffic. A more recent retail development has been the "warehouse" style of hardware and other stores, with products displayed on warehouse type shelving and wide aisles to accommodate motorized vehicles such as fork lifts used in carrying large quantities of items on the sales floor.

As a result, there has been an increasing need to take maximum advantage of retail display space in order to attract the attention of shoppers and to utilize space occupied by the aisles. There is a further need for a simplified display fixture which is of rugged construction and can be economically fabricated and installed.

SUMMARY OF THE INVENTION

This object has largely been met by the present invention which enables the retailer to take further advantage of the retail sales floor by extending product displays laterally into the aisle. The present invention presents a multitude of advantages to the retailer, in that it is simple, uses unoccupied space, is substantially impervious to wear, resists tampering, and yields to both human and vehicular traffic by allowing the display arm to swing when engaged. The device hereof further permits not only the product itself to extend into the aisle in an eye-catching manner, but additional advertising to be displayed so as to be visible when the customer walks down the retail aisle.

Broadly speaking, the present invention includes a mount and a display arm swingably carried by the mount. The arm and mount cooperate so that the arm is not only self centering but accomplishes this without the need for any biasing mechanism. Further, the arm employs a centering device which aids in preventing excess swinging and helps to keep the arm positioned substantially normal to a mounting surface. The arm preferably includes a hinge portion at its proximal end and a product carrier at its remote end, whereby the product may be carried at an extended distance from the supporting surface. The product carrier may itself be swingably held relative to the arm so as to hang therefrom. An advertising carrier may be coupled to the display arm intermediate the proximate and distal ends of the normally horizontal portion.

The mount of the present invention includes a backplate which may be attached to upright shelving supports or other mounting surface by a coupler which is integrated into the mount. The coupler preferably includes tabs complementally configured to the respective mounting surface so that the mount may drop into place. A tightening screw is provided on the mount to maintain tension and resist tampering. An arm support extends downwardly at an angle from the backplate to receive the hinge portion of the arm, and further includes a recess for cooperating with the centering device. The recess is preferably in the form of an opening having a smaller dimension than the transverse dimension of the centering device, so that the centering device is received by the recess but does not pass through. The arm support around the opening is preferably beveled or otherwise widened at the upper surface of the arm support in comparison to the lower surface in order to facilitate both centering of the arm and the initial disengagement of the centering device from the recess upon engagement of the arm by a moving object to permit swinging of the arm.

As a result, the fixture is sturdy, easy to mount and maintain, and substantially safer than ordinary fixtures which fail to yield when encountered. The device is inexpensive to manufacture and requires no biasing mechanisms such as springs to maintain the extended orientation. By using a hanging product carrier, multiple articles may be carried and presented to attract the purchasers' attention. These and other advantages will be readily understood by those skilled in the art with reference to the attached drawings.

DESCRIPTION OF THE PREFERRED EMBODIMENT

Figure 1:
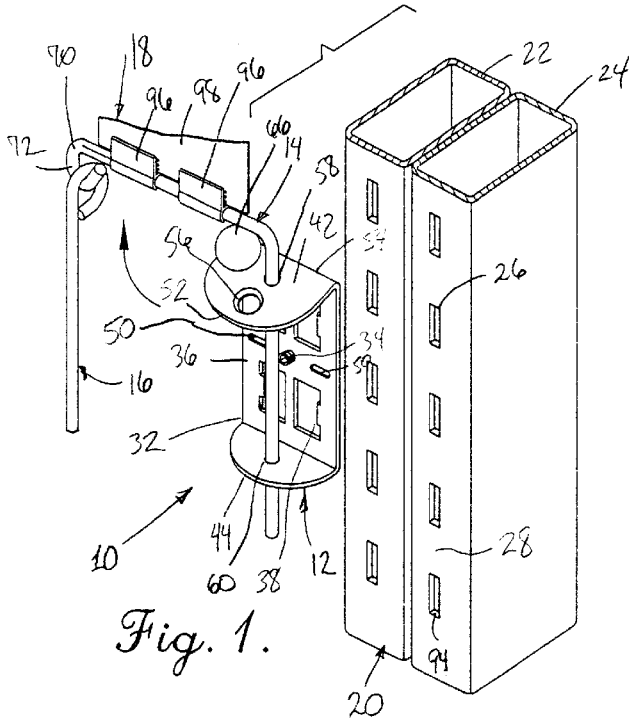
FIG. 1 is a perspective view of the fixture of the present invention, showing the product carrier foreshortened and the mount ready for attachment to the upright support of a shelving structure.
Figure 2:
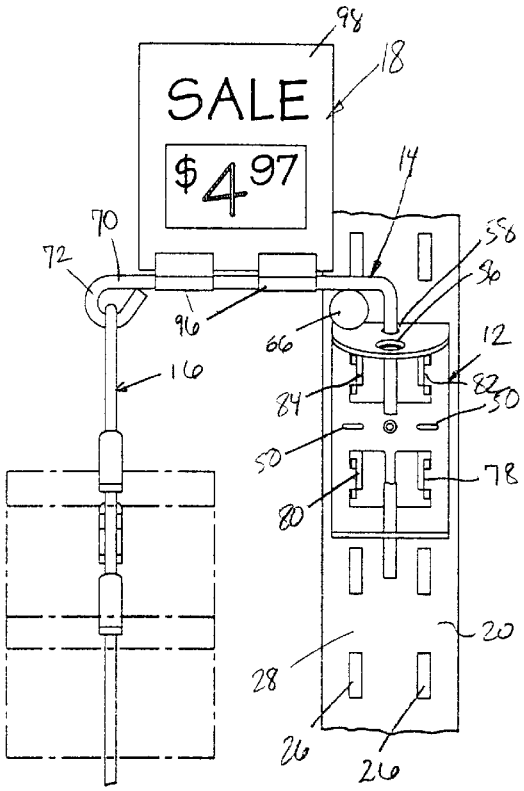
FIG. 2 is a front elevation view of the invention mounted to a shelving support, showing the arm pivoted to the side with an advertising display coupled to the display arm and two articles of merchandise clipped to the product carrier shown in phantom.

Referring now to the drawing, a self-centering display fixture 10 broadly includes a mount 12, a display arm 14 swingably carried by the mount 12, a product carrier 16 carried remotely on the arm 14 from the mount, an advertising display 18 coupled to the display arm 14, and mounting surface 20 to which the mount 12 is coupled. As shown in FIG. 1 of the drawing, mounting surface 20 is provided of upright shelving supports 22 and 24 in parallel, side by side disposition, each having mounting openings 26 which may be rectangular in shape as shown, but as is well known, may also be keyhole shaped of contiguous hole portions and slot portions. The shelving supports may also be of wider, one-piece construction as shown in FIG. 2. The openings 26 are located in a face 28 oriented toward the aisle 30 between shelving rows, on end caps of such shelving, or other advantageous locations. In the case of the keyhole shaped openings, the slot portions have narrower transverse dimensions than the hole portions, while in the case of the rectangular openings as shown, it is customary but not required that the shelving supports are positioned with the transverse dimension of the opening 26 narrower than the vertical dimension. However, this is merely provided as an example of one type of mounting support for the fixture 10, and it may be appreciated that there are numerous types of shelving, display racks and other commercial fixtures which may be used to support the invention hereof.

Figure 4:
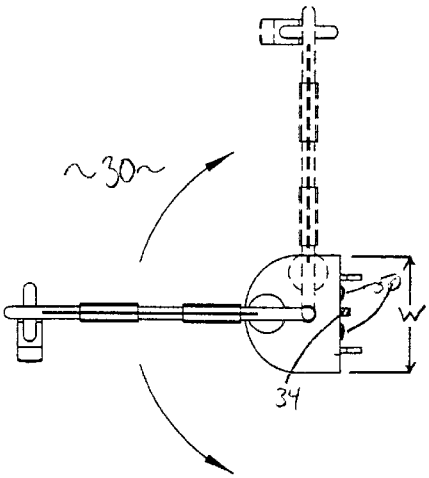
FIG. 4 is a top plan view showing the arm and product carrier in a centered position and also in deflected positions in phantom.

In greater detail, the mount 12 is of simplified construction requiring only a plate member 32 which may be cast, cut and bent, or forged into shape. An optional securing screw 34 may be threadably received by the plate member 32. The plate member 32 is preferably formed to include a backplate 36, coupler 38, securing screw 40 opening, arm support 42 and lower hinge flange 44. The backplate 36 is normally oriented to be upright and parallel to face 28, with its back side 46 oriented toward face 28 and its front side 48 oriented away from the face 28. The securing screw opening 40 is preferably centered in the backplate 36 and internally threaded to receive securing screw 34 therethrough, and a pair of bosses 50 attached or more preferably embossed into the backplate 46 to slightly project or bulge from the surrounding portions of the back side 46 of the backplate 36 as shown in FIG. 4 to facilitate stability and prevent side-to-side wobble when the securing screw 34 is tightened against the face 28. Securing screw 34 is preferably an Allen screw which inhibits tampering.

Figure 3:
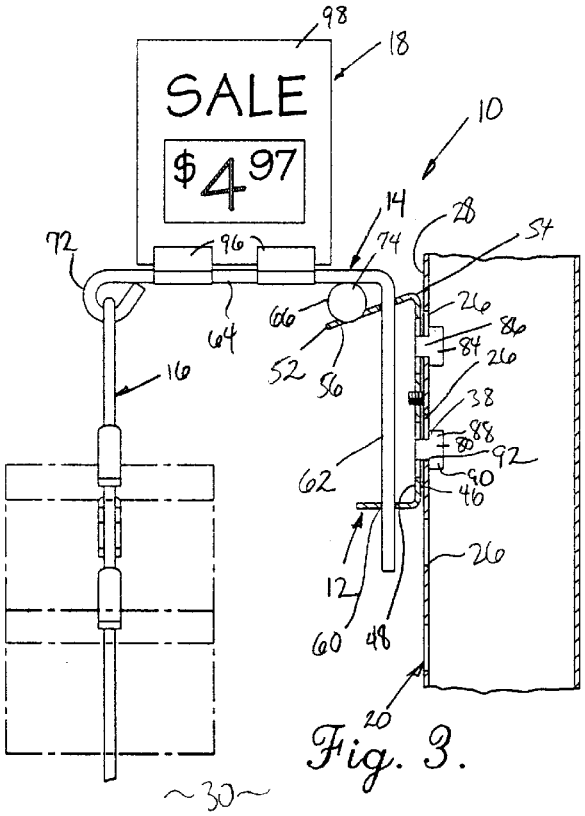
FIG. 3 is a side elevation view showing the display arm in an extended orientation into the aisleway of a retail facility.

The arm support 42 and lower hinge flange 44 are preferably integrally formed with backplate 36 by bending metal to the desired configuration toward the front side of the backplate 36. Arm support 42 is bent downwardly relative to the horizontal so that its outboard edge 52 is lower than its inner corner 54, and extends forwardly from the front side of the backplate 36 as shown in FIG. 3. A centering depression 56 provided as centering hole and an upper hinge hole 58 are provided in the arm support 42, the hinge hole 58 being located more proximate to the inner corner 54 and the centering depression 56 being located more proximate to the outboard edge 52. The centering depression 56 is preferably provided with a progressively greater diameter from top to bottom such as by chamfering. The centering depression 56 and upper hinge hole 58 are preferably centered on the width W of the arm support 42 to enhance bidirectional swinging and centering, as illustrated in FIG. 4. The lower hinge flange 44 extends forwardly from the front side of the backplate 36 in a direction preferably substantially perpendicular to the backplate 36 and has a lower hinge hole 60 which is preferably in vertical alignment with upper hinge hole 58 to define a vertical pivot axis for the display arm 14 when in use.

The display arm 14 is preferably bent to be substantially L-shaped and includes an upright pivot rod 62 passing through the hinge holes 58 and 60 an extension arm 64 oriented generally normal thereto. A centering device 66 is fixed to the extension arm 64. The extension arm 64 has a proximal end 68 at the bend and a remote end having a stop 70 shown as an eye 72 to which the upper end of the product carrier 16 may be attached. The pivot rod 62 has a lower end 74 to which a removable cap of elastomeric material such as rubber may be press fitted thereon. The centering device 66 is preferably a sphere or other shape provided with an arcuate lower surface 76 and welded to the underside of the extension arm 64. The centering device 66 is positioned so that when the pivot arm 62 is swingably received in the hinge holes 58 and 60 whereby the extension arm 64 is generally perpendicular to the backplate 36, the arcuate lower surface 76 is received in centering hole 56, with the diameter or transverse dimension of the lower surface 76 being greater than the diameter of the centering hole 56 to prevent passage of the centering device 66 through the centering hole 56.

The coupler 38 is preferably provided as a plurality of tabs 78, 80, 82 and 84 laterally and vertically spaced into rows and columns to extend rearwadly from the back side 46 of backplate 36. The tabs are spaced to be complemental to the spacing of the openings, that is, the tabs are spaced the same distance apart as the mounting openings 26 on the shelving supports 22 and 24. Preferably, the tabs 78, 80, 82 and 84 are integrally formed with the backplate 36 of mild steel or aluminum and are formed by cutting the tabs from the backplate 36 and bending them to extend substantially perpendicularly and rearwardly therefrom. The tabs 78, 80, 82 and 84 are preferably formed to be T-shaped, each including a central support flange 86 from which project upper flange 88 and lower flange 90 to present a support-receiving notch 92 between the lower flange and the backplate 36. The tabs are of a width preferably complemental to permit receipt into the openings 26, whereby the lower edge 94 of the opening 26 receives the central support flange 86 thereon when the fixture 10 is mounted to the mounting surface 20.

The advertising insert 18 includes at least one clip 96 removably attached to the extension arm 64 and a display 98 attached thereto. The display 98 may be in the form of a card or other display device such as a light which catches the customer's attention and may include indicia containing information about the product, such as price, description or the like.

The product carrier 16 includes a hanger 100 of, for example, wire or rod-like construction, which has a loop 102 at the upper end thereof, and at least one and preferably a plurality of attachments 104 such as clips connected to the hanger and from which individual products 106 may be removably secured. It may be appreciated that the attachments may also include hooks, prongs or other devices to which the products may be readily attached and removed. The loop 102 is of sufficient inside diameter to interfit and couple with the eye 72 as shown in FIGS. 1–4.

The display arm 14 and mount 12, and particularly the upper surface of the arm support 42 and centering device 66, may be painted or otherwise coated with a glossy paint or other coating which promotes sliding of the sphere across the upper surface of the arm support 42, or provided in an uncoated condition. The arm support 42 also preferably is of a sufficient width W, and the centering device 66 is located on the extension arm 64 so that the centering device 66 remains on the arm support 42 during swinging of its full range of motion as illustrated in FIG. 4. The extension arm portion of the display arm is shown in its centered position in solid lines in FIG. 4, and also in a 90 degree displacement from the centered position in phantom lines. It is to be understood, as shown by the arrows, that the extension arm is equally capable of swinging through a 90 degree range in the opposite direction, so that a total range of motion is at least 180 degrees in the preferred embodiment.

In use, the display fixture 10 is assembled by slipping the loop 102 of the product carrier 16 over the eye 72 of the arm 14. The advertising display 18 is then clipped to the extension arm 64. The mount 12 is attached to the mounting surface 20 by first inserting the tabs 78, 80, 82 and 84 into their corresponding openings 26 and then moving the fixture 10 downwardly whereby the lower edge 94 of each opening 26 receives the corresponding tab's central support flange 86 thereon and the lower flanges hook behind the face 28. In this position, the upper hinge hole 58 and the lower hinge hole 60 are in vertical alignment, as shown in FIGS. 2 and 3. The securing screw 34 is then tightened against the mounting surface 20 to hold the mount 12 in proper position.

Once the mount 12 is positioned, the lower end 74 of the pivot rod 62 is passed through each of the upper hinge hole 58 and lower hinge hole 60, and if desired the cap may be is attached to the lower end 72 to inhibit removal. The individual products 106 are then placed on the attachments 104, and the display fixture 10 is ready for use.

As the extension arm 64 extends into an aisle 34, it may be touched by a customer or struck by a vehicle. In that instance, the display arm 14 is free to swing so that the extension arm 64 and product carrier 16 yield to the force applied. As the extension arm swings, the sphere centering device 66 moves out of centering hole 56 and slides across the upper surface of the arm support 42. The angled upper surface of the arm support 42 thereby causes the display arm 14 to increase in height as it swings across the arm support. When the display arm 14 is free to swing back, gravity acts on the arm and the low frictional resistance between the lower surface 76 of the centering device 66 and the upper surface of the arm support 42 allows gravity along to act on the display arm and cause it to return to its original, centered position as shown in FIG. 3. During such swinging, the extension arm 64 might move through a multiplicity of oscillations, but the lower surface 76 drops partially into the centering hole 56, located at the lowermost position possible during swinging and thus the natural position of repose, during each swinging movement. This retards further swinging movement and as a result, the extension arm 64 quickly returns to its normal and desired position substantially perpendicular to the face of the mounting surface. It may be appreciated that the additional weight of the individual products on the product carrier 16 only serves to increase the weight on the lower surface 76 and improves the resulting performance of the display fixture 10 without significantly inhibiting its ability to swing once touched. The fact that the product carrier 16 is itself swingably mounted to the extension arm 64 also helps the avoid damage to the display fixture 10 or damage to the individual products 106 resulting from impact or dislodgment causing them to fall to the floor of the aisle.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. As examples of such modifications, the mount 12 may be modified for attachment to a variety of different supports, including walls and horizontal surfaces, and the centering device may be modified from a sphere to other configurations which aid self-centering of the arm 14. As used herein, the term "centering depression" refers not only to a hole as illustrated, but also encompasses an embossed depression or any relieved area which receives and serves to releaseably capture a portion of the centering device when the display arm is in a centered position. The fixture 10 may be manufactured in a variety of methods, including die casting, cutting from sheet stock, as well as fabrication and welding, and the fixture or components thereof may be molded of synthetic resin as well as metal such as steel or aluminum.

The inventors hereby states their intent to rely on the Doctrine of Equivalents to determine and assess the reasonably fair scope of his/their invention as pertains to any apparatus not materially departing from but outside the literal scope of the invention as set out in the following claims.

What is claimed is:

1. A display surface for mounting to a mounting surface comprising:

a mount presenting a backing member having a front side and a rear side, an arm support unitary with an angularly oriented and extending downwardly and forwardly from the front side of the backing member, the arm support having an upper hinge hole relatively proximate said backing member and a centering depression relatively remote from said backing member, and a lower hinge flange unitary with and extending angularly from the front side of said backing member and having a lower hinge hole substantially aligned with said upper hinge hole;

a display arm having a pivot arm portion swingably carried by said mount and passing through said upper hinge hole and lower hinge hole whereby said display arm is supported on said arm support and said upper hinge hole in said arm support and said lower hinge hole in said lower hinge flange define a pivot axis for said pivot arm portion, and an extension arm portion angularly oriented relative to said pivot arm portion, and a centering device attached to said extension arm portion, said centering device being positioned on said extension arm portion so as to releasably engage said centering depression in a centered position substantially perpendicular to said backing member and to release from said centering depression for shiftable movement along said arm support to thereby permit swinging movement of said display arm from said centered position; and a coupler integrally formed with said backing member of said mount and extending rearwardly from the rear side of said backing member for orienting said pivot arm in an upright axis when said display fixture is mounted to the mounting surface.

2. A display fixture as set forth in claim 1, including a screw threadably received in said backing member and coupled to the backing member for shifting said backing member away from the mounting surface.

3. A display fixture as set forth in claim 1, wherein said arm support is substantially planar and has a width sufficient to engage said centering device during swinging movement of said extension arm portion through a range of 90 degrees lateral displacement from a centered position wherein said centering device is received in said centering depression.

4. A display fixture as set forth in claim 1, wherein said centering device has an arcuate lower surface complementally sized for partial receipt in said centering depression.

5. A display fixture as set forth in claim 4, wherein said centering device is a sphere.

6. A display fixture as set forth in claim 1, wherein said centering depression is a hole extending through said arm support.

7. A display fixture as set forth in claim 6, said hole in said arm support has a diameter sufficiently small to prevent the passage of the centering device therethrough.

8. A display fixture as set forth in claim 1, wherein said coupler has at least one rearwardly extending tab.

9. A display fixture as set forth in claim 8, wherein said tab includes a central support flange and a lower flange oriented to present a support-receiving notch between the lower flange and the backing member.

10. A display fixture as set forth in claim 9, including a plurality of said tabs laterally spaced in a row.

11. A display fixture as set forth in claim 9, including a plurality of said tabs vertically spaced in a column.

12. A display fixture as set forth in claim 1, including an advertising display coupled to said extension arm portion.

13. A display fixture as set forth in claim 12, wherein said advertising display includes at least one clip removably coupled to said extension arm portion.

14. A display fixture as set forth in claim 1, including a product carrier supported on said extension arm portion.

15. A display fixture as set forth in claim 14, wherein said product carrier is swingably coupled to said extension arm portion.

16. A display fixture as set forth in claim 15, wherein said product carrier includes a hanger presenting a loop receiving said extension arm portion therethrough.

17. A display fixture as set forth in claim 16, wherein said extension arm portion includes a remote end and a stop connected to said extension arm portion at said remote end, and wherein said stop is configured to prevent the passage of the loop therepast.

18. In a retail display including an upright support presenting a front face having a plurality of vertically aligned openings therein, the improvement comprising a display fixture having:

a mount presenting a backing member having a front side and a rear side, a substantially planar arm support formed unitarily with and angularly oriented and extending downwardly and forwardly from the front side of the backing member, the arm support having an upper hinge hole relatively proximate said backing member and a centering depression relatively remote from said backing member, and a lower hinge flange formed integrally with and extending angularly from the front side of said backing member and having a lower flange hole substantially aligned with said upper hinge hole;

a display arm having a pivot arm portion swingably carried by said mount and passing through said upper hinge hole and lower hinge hole, and an extension arm portion angularly oriented relative to said pivot arm portion, and a centering device attached to said extension arm portion, said centering device being positioned on said extension arm portion so as to engage said centering depression in a centered position substantially perpendicular to said backing member and to permit swinging movement of said extension arm portion from said centered position; and a coupler integral with said mount proximate the rear side of said backing member and inserted through said openings for coupling the mount to said upright support with said pivot arm oriented in an upright axis, whereby the height of said display arm increases during swinging of said extension arm portion from its centered position.

19. A retail display as set forth in claim 18, including a product carrier swingably carried by the extension arm portion.

20. A method of displaying merchandise on a mounting surface adjacent an aisle comprising the steps of:

providing a retail display having a mount, a coupler adapted for attaching the mount to the mounting surface, a display arm including a pivot arm mounted to the mount for pivoting about an upright axis and an extension arm angularly oriented relative to the pivot arm, and a product carrier adapted to mount merchandise thereon coupled to the display arm, the display arm including a centering member and the mount including a centering depression complementally sized with the centering member for releaseably receiving the centering member when the arm is oriented in a centered position;

coupling the retail display to the mounting surface to position the pivot arm in a substantially vertical axis; and pivoting said display arm relative to said mount upon the engagement of the pivot arm by an external force to move the centering member relative to the centering depression and automatically returning the centering member into receipt by the centering depression upon removal of the external force by gravity whereby the display arm returns to a centered position.

21. A method as set forth in claim 20, wherein the display arm is biased by gravity to a centered position substantially perpendicular to said mounting surface and wherein said centering member is received in said centering depression.

* * * * *